US007607550B2

(12) United States Patent
Lin et al.

(10) Patent No.: US 7,607,550 B2
(45) Date of Patent: Oct. 27, 2009

(54) PORTABLE AND STACKABLE PLASTIC MULTIPURPOSE CONTAINER

(75) Inventors: Pei-Ying Lin, Taichung Hsien (TW); Chanwa Nguy, Cornelius, NC (US)

(73) Assignee: Steelworks Hardware, LLC, Northbrook, IL (US)

( * ) Notice: Subject to any disclaimer, the term of this patent is extended or adjusted under 35 U.S.C. 154(b) by 578 days.

(21) Appl. No.: 10/555,159

(22) PCT Filed: Oct. 26, 2005

(86) PCT No.: PCT/US2005/039396

§ 371 (c)(1),
(2), (4) Date: Dec. 1, 2005

(87) PCT Pub. No.: WO2007/067160

PCT Pub. Date: Jun. 14, 2007

(65) Prior Publication Data

US 2008/0197040 A1 Aug. 21, 2008

(51) Int. Cl.

| | |
|---|---|
| ***B65D 43/14*** | (2006.01) |
| ***B65D 43/12*** | (2006.01) |
| ***B65D 21/02*** | (2006.01) |

(52) U.S. Cl. ..... 220/252; 220/345.5; 206/509

(58) Field of Classification Search ..... 220/4.26, 220/4.27, 252, 345.1, 345.5, 608, 669; 206/503, 206/508, 509; *B65D 8/18, 6/28*
See application file for complete search history.

(56) References Cited

U.S. PATENT DOCUMENTS

| | | | |
|---|---|---|---|
| 1,577,823 | A | 3/1926 | Dolle |
| 4,966,284 | A | 10/1990 | Gregerson et al. |
| 5,383,556 | A | 1/1995 | Van Loo |
| 5,445,397 | A | 8/1995 | Evans |
| 6,478,204 | B2 | 11/2002 | Lange et al. |
| 2003/0234200 | A1 | 12/2003 | Diamant |

FOREIGN PATENT DOCUMENTS

| | | | |
|---|---|---|---|
| DE | 3130578 | A1 | 3/1983 |
| JP | 2002154604 | A | 5/2002 |

*Primary Examiner*—Harry A Grosso
(74) *Attorney, Agent, or Firm*—Levenfeld Pearlstein, LLC

(57) ABSTRACT

Portable and stackable multipurpose containers are disclosed. The containers have an oval base and an oval top in communication with sides of the wall extending perpendicularly from the base. The oval top is slidably positioned to open from both sides, which are perpendicular to the oval sides; the top is slidable. The multipurpose container is adapted for storing nails, screws, and similar items useful to craftsmen.

31 Claims, 12 Drawing Sheets

PORTABLE AND STACKABLE PLASTIC MULTIPURPOSE CONTAINER

FIELD OF THE INVENTION

The present invention relates to a portable and stackable plastic multipurpose container having a plastic boxlike structure including a base with a concave surface and a top having a convex surface congruent to the concave surface of the base, and suitable for stacking.

These portable and stackable plastic multipurpose containers are suitable for storing nails, screws, and other small items used by craftsmen. For convenient storage, these portable and stackable plastic multipurpose containers are stacked.

BACKGROUND AND RELATED ART

A variety of tool cases have been disclosed. The present invention provides a versatile portable and stackable plastic multipurpose container suitable for holding nails, screws, and other similarly sized related items. The portable and stackable plastic multipurpose container can be opened from both sides of the top, thus facilitating the use of the container. An advantage of the portable and stackable plastic multipurpose containers of this invention is that the containers are designed to be stackable. This property saves space, since only a relatively small space is needed to store many of the portable and stackable plastic multipurpose containers of this invention.

The following references are of interest, but are clearly unrelated to the claimed invention.

U.S. Pat. No. 5,383,556 to Van Loo discloses a container for small objects that is provided with a glide closure.

U.S. Pat. No. 6,478,204 B2 to Lange, et al. discloses a receptacle having a translatably-guidable cover.

SUMMARY OF THE INVENTION

This invention is directed to a portable and stackable plastic multipurpose containers ("container") suitable to be stacked. The container includes a base with a concave surface, a top, a pair of side walls, a front wall, and a rear wall. The top is formed from slidable convex panels wherein the convex curvature of the panels is substantially congruent to a portion of the concave surface of the base. The pair of opposed, substantially identical, side walls extend perpendicularly from the base and have a curved upper portion congruent with a curvature of the top. The side walls' curved upper portion has a top and a bottom of the curve. The front and rear walls extend perpendicularly from the base and the slidable convex panels of the top of the container slide to meet the bottom of the top and a top of the front and rear walls. The top slidable panels are positioned to form at least a portion of two sides of the container. Suitably, the top panels are slidably positioned to open from either the front or the rear of the container. The top is also slidable laterally along a length of the front and rear walls. Preferably, each panel of the top has a plastic connecting member to close each panel to one or more of the front/rear walls and the top is engageable with one or more of the side walls. Advantageously, a plurality of supporting structures strengthen the base of the container. Preferably, these supporting structures are located on the base inside the container. The stacking of the containers is facilitated by providing the top with two tenons, which engage two mortise apertures at the bottom of the base, thus securing the stack. The containers of this invention are particularly suitable for carrying nails, screws, and other similarly sized items used by craftsmen.

The containers of this invention are used independently. However, to save space in storage, a plurality of containers of this invention are stacked. This is suitably accomplished wherein for each set of two containers, the two tenons on the top of one container have been inserted in the two mortise apertures of the bottom of the base of the other container. Suitably, the stacks of plastic containers have curved or convex rectangular bases, curved or convex square bases, or bases having a different configuration.

DETAILED DESCRIPTION OF THE INVENTION

Figure 1:
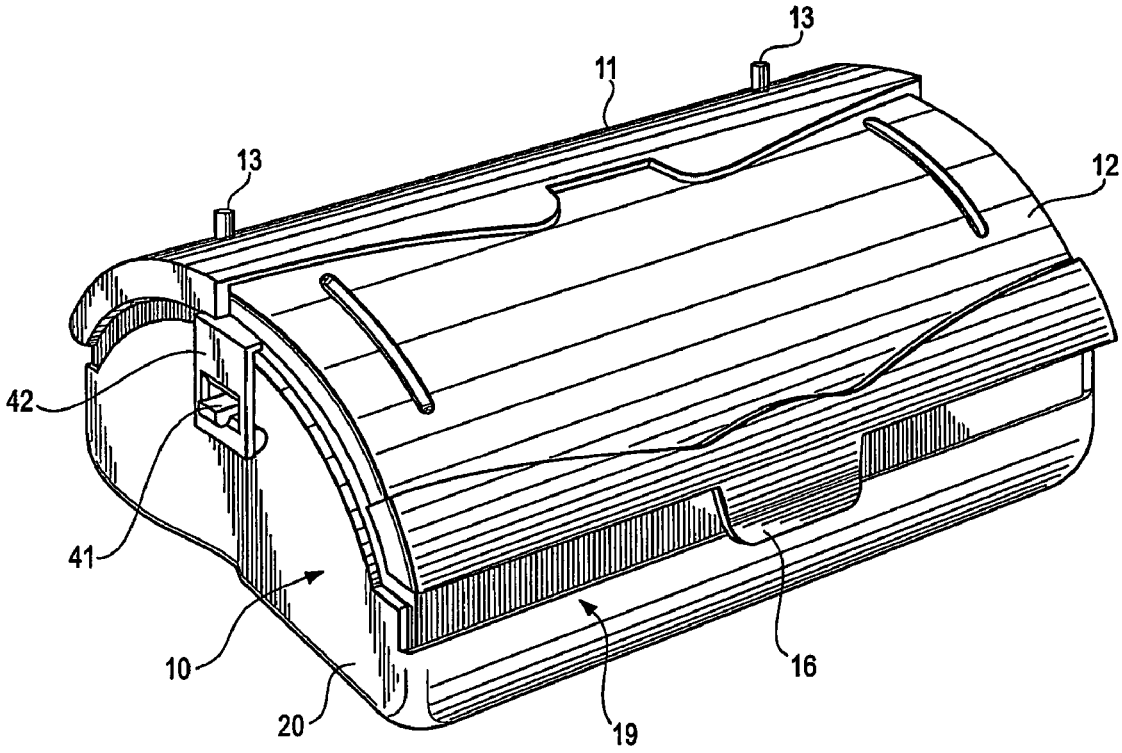
FIG. 1 is a perspective view of a portable and stackable plastic multipurpose container in accordance with the principles of the present invention.

This invention is directed to a portable and stackable plastic multipurpose containers ("container") suitable to be stacked. The container includes a base with a concave surface, a top, a pair of side walls, a front wall, and a rear wall. The top is formed slidable convex panels which are slidable, wherein the convex curvature of the panels is substantially congruent to a portion of the concave surface of the base. The pair of opposed, substantially identical, side walls extend perpendicularly from the base and have a curved upper portion congruent with a curvature of the top. The side walls' curved upper portion has a top and a bottom of the curve. The front and the rear walls extend from the base to a bottom portion of the top. The front and rear walls extend perpendicularly from the base and the slidable convex panels of the top of the container slide to meet the bottom of the top and an upper surface of the front and rear walls. The top slidable panels are positioned to form at least two sides of the container. Suitably, the top panels are slidably positioned to open from either the front and/or the rear of the container. The top is also slidable laterally along a length of the front and rear walls. Preferably, each panel of the top has a plastic connecting member to close each panel to one or more of the front/rear walls and the top is engageable with one or more of the side walls. In addition, the top preferably has a latch which engages the top to the side wall(s).

Advantageously, a plurality of supporting structures strengthen the base of the container. Preferably, these supporting structures are located on the base inside the container. The stacking of the containers is facilitated by providing the top of the container with two tenons, which engage two mortise apertures at the bottom of the base, thus securing the stack. The containers of this invention are particularly suitable for carrying nails, screws, and other similarly sized items used by craftsmen.

In another embodiment, the container is provided with a rectangular base, (b) a top, and (c) a pair of opposed substantially identical side walls extending perpendicularly from a shorter side of the rectangular base with a curved upper portion. The curved upper portion of the side walls have a top and a bottom. Front and rear walls are provided, each having a length greater than that of either of the side walls. These front and rear walls extend perpendicularly from the longer sides of the rectangular base. The top panels are slidably positioned to open from at least two sides preferably from the front and rear of the container. Each panel of the top of the container is provided with a plastic connecting member to close each top panel to the its respective front or rear wall. The container base is strengthened by a plurality of supporting structures located on the base inside the container and outside the container. To facilitate stacking, the top is provided with two tenons, which connect to the mortise aperture located at the bottom of the base of a second container. The top including both panels are provided with means which enable the top to move laterally/longitudinally over the curved sidewall thus facilitating the removal of objects stored in the container of this invention.

An additional embodiment provides a portable and stackable plastic multipurpose container with a square base. In all these configurations, the base of the container is strengthened by the supporting structures and the top and bottom of the container have a configuration with surfaces congruent to one another. In all these configurations, the top, including both sides, are provided with means which enable the top to move laterally along a length of the container thus facilitating the removal of objects stored in the portable and stackable plastic multipurpose container of this invention.

DETAILED DESCRIPTION OF THE DRAWINGS

FIG. 1 is a view of the rectangular portable and stackable plastic multipurpose container (10) wherein the top (21) is shown with both panels (11) and (12) closed, and also showing two tenons (13), locking one handle (16) into front wall (19). Also shown is a connector (41) and a latch (42).

Figure 2:
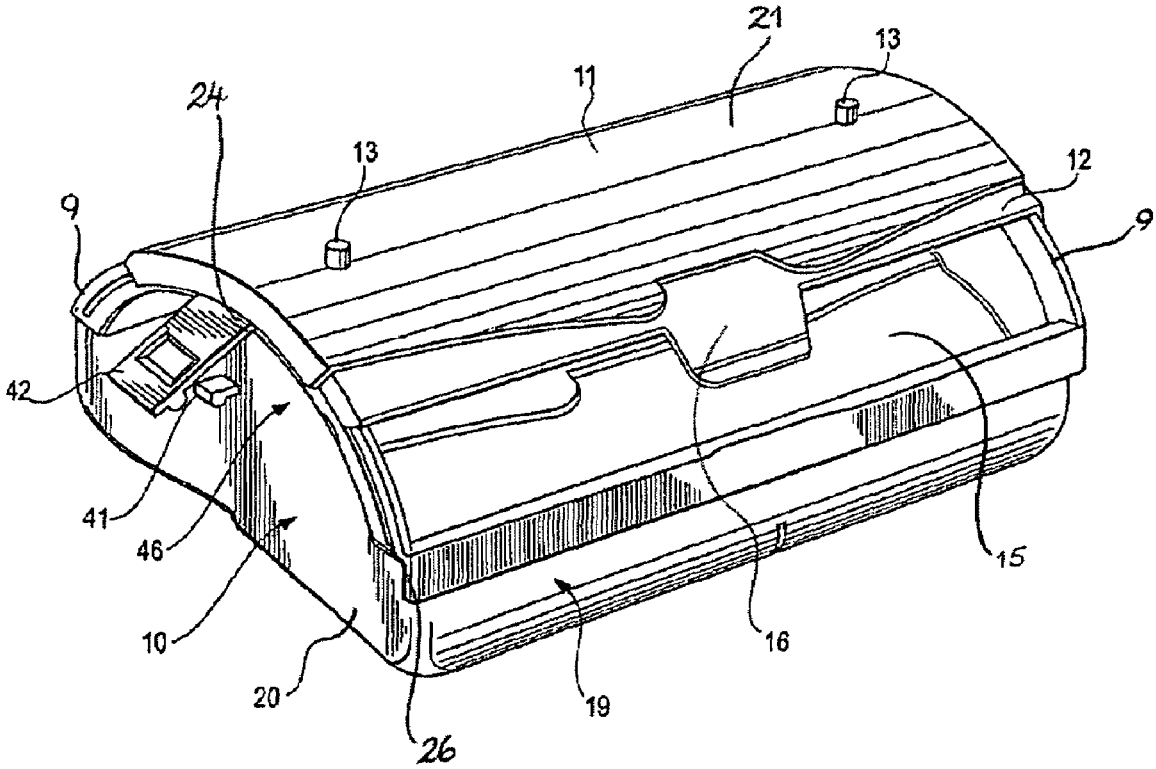
FIG. 2 is a perspective view of the container of FIG. 1 with both top panels open and showing the support structures located on the base inside the container.

FIG. 2 is a view of the rectangular portable and stackable plastic multipurpose container (10) showing the top's panels (11) and (12) slidable and open showing the bottom of the multipurpose container (14) having a plurality of supporting structures (15). Also shown are the locking mechanisms (16) on the top of each of the panels (11) and (12) and the bottom of the locking mechanism (17) in the middle of the front wall of the rectangular portable and stackable plastic multipurpose container (10).

Figure 3:
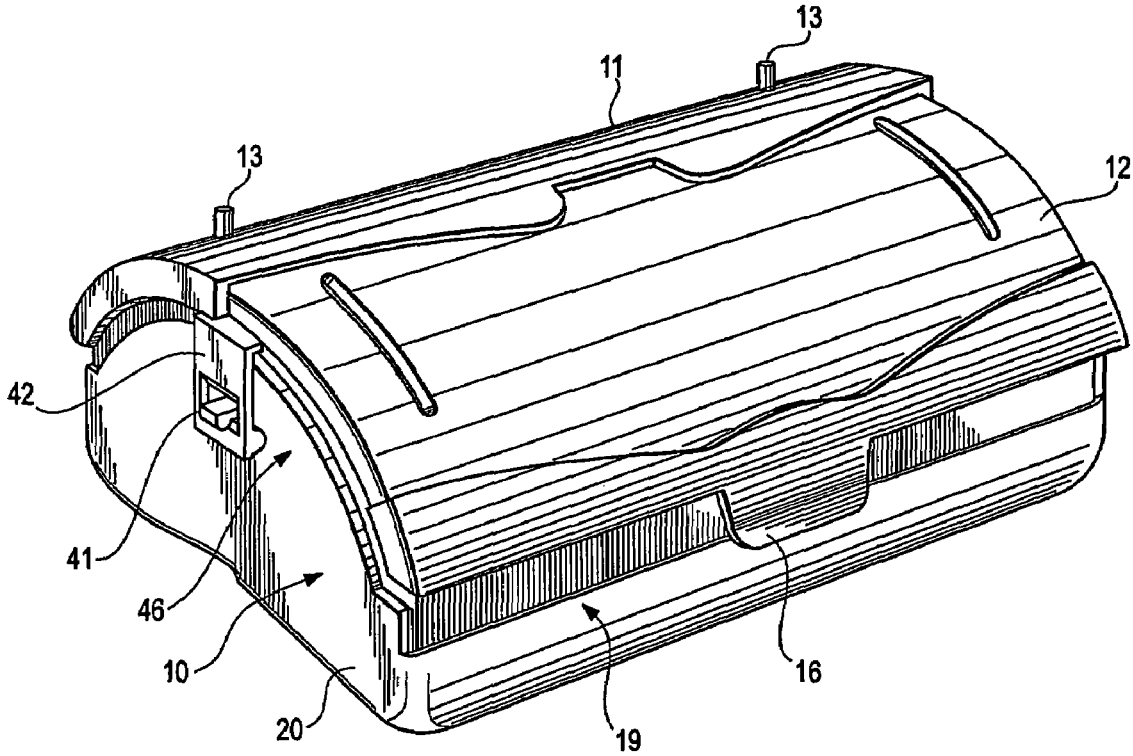
FIG. 3 is a perspective view of the container of FIG. 1 illustrating an aperture, which facilitates the closing of the container.

FIG. 3 illustrates the rectangular portable and stackable plastic multipurpose container (10) with both panels (11) and (12) closed and showing the two tenons (13), the locking mechanism (16), the front wall (19) of the rectangular container (10) and a first side wall (20). Also shown are a connector (41) and a latch (42), wherein the connector 41 is positioned on the first side wall and the latch is attached to the top and positionable such that the latch 42 is engageable with the connector 41 to prevent the top 21, panels 11, 12, from moving.

Figure 4:
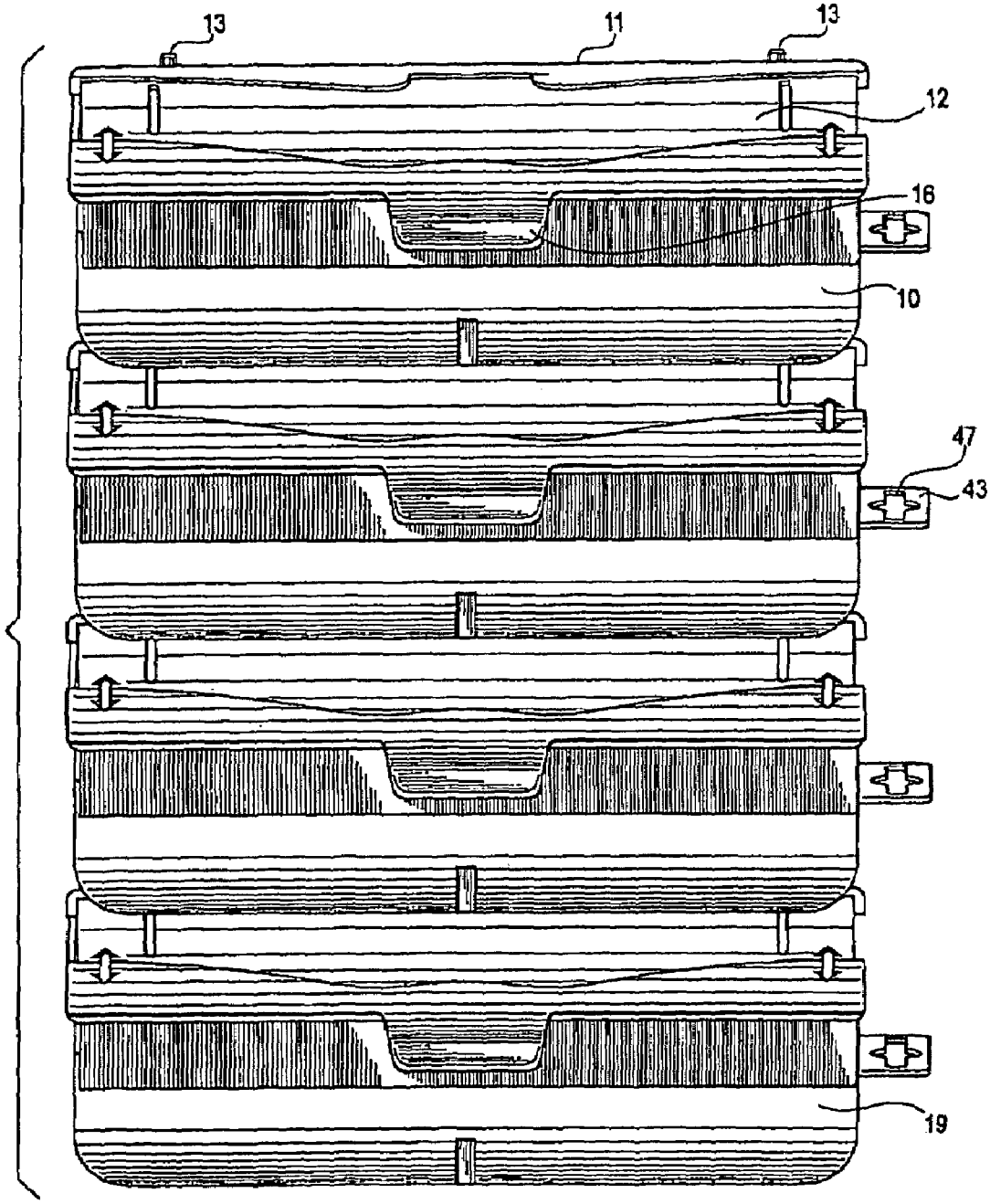
FIG. 4 is a perspective view of the container with a top panel closed showing the closing mechanism and stacking.

FIG. 4 shows a stack of four rectangular portable and stackable plastic multipurpose containers (10) with the top panels (11) and (12) closed. Also shown are the locking mechanisms (16), two tenons (13) and a flange (43) with an aperture (47) through which can be passed a connecting wire or rod to stabilize the stack (48) if necessary.

Figure 5:
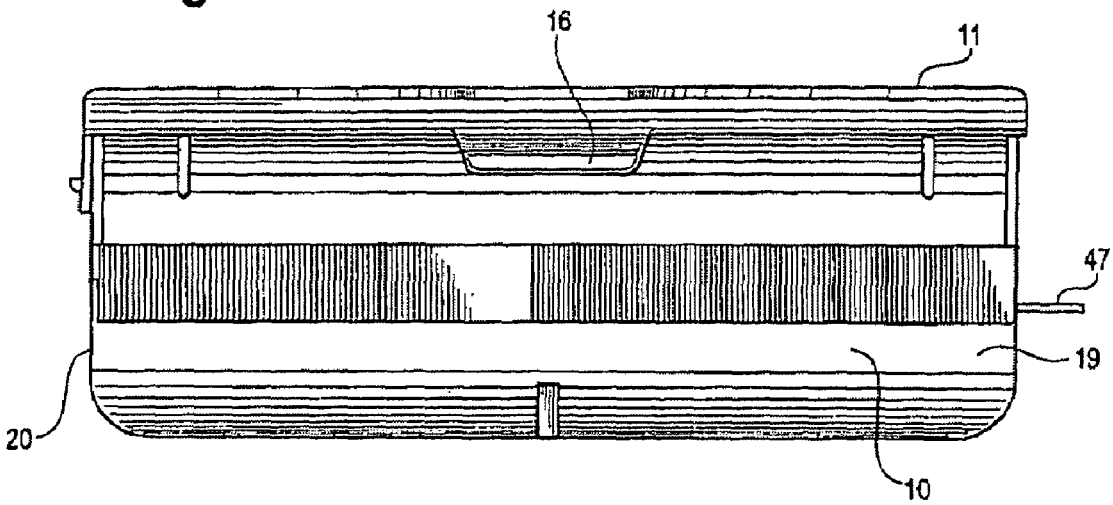
FIG. 5 is a front view of the container with the top front panel open.

FIG. 5 illustrates a side view of the rectangular portable and stackable plastic multipurpose container (10) with the top panel (11) open from the side adjacent the front wall (19).

Figure 6:
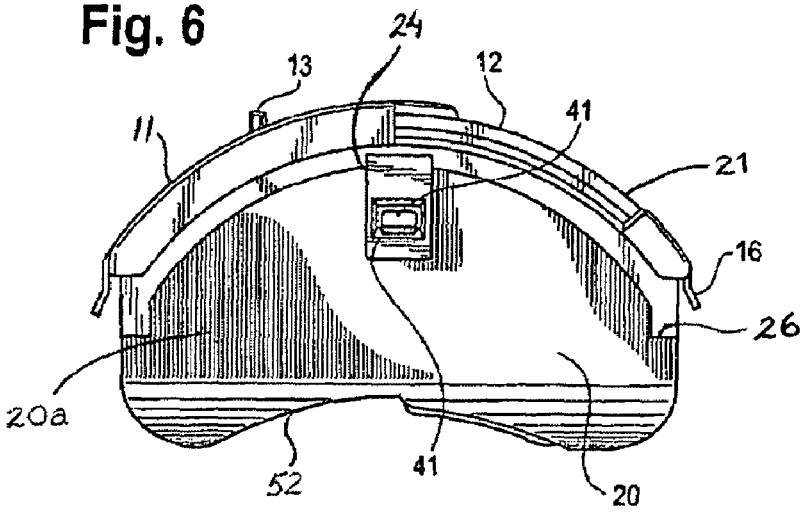
FIG. 6 is a side view of a first side of the container showing the curved upper portion, the concave base and a connecting system whereby the top is fastened to the sidewall.

FIG. 6 is a side view of the rectangular portable and stackable plastic multipurpose container (10) from the first side wall (20*a*) showing the first side wall (20*a*) and a connecting system whereby the top (21) is fastened to the sidewall (20*a*. The top 21 is slidable, movable to open the container (10).

Figure 7:
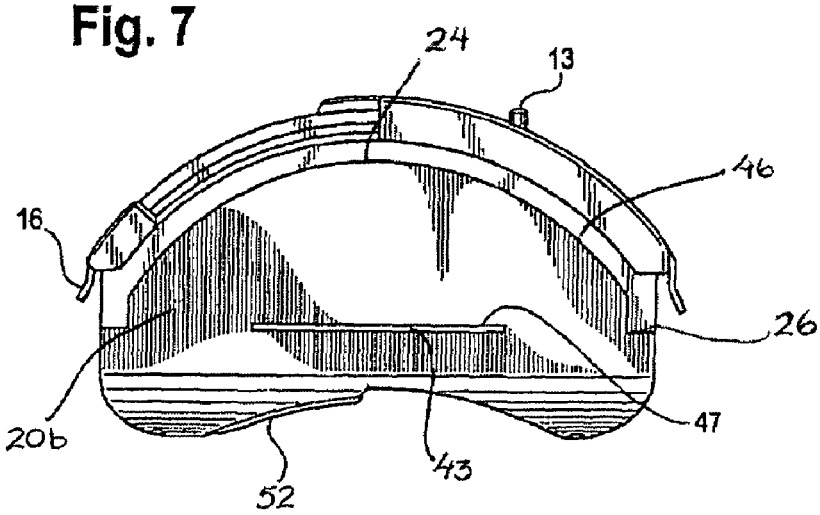
FIG. 7 is a side view of a second side of the container showing the curved upper portion and the protruding flange, which supports the stacking of the plurality of the containers.

FIG. 7 is a side view of the second side wall (20*b*) of the rectangular portable and stackable plastic multipurpose container (10). The second side wall (20*b*) is opposite the first side wall (20*a*) shown in FIG. 6, and includes the curved upper portion (46) with an apex (24) and a plateau (26), and the flange (43).

Figure 8:
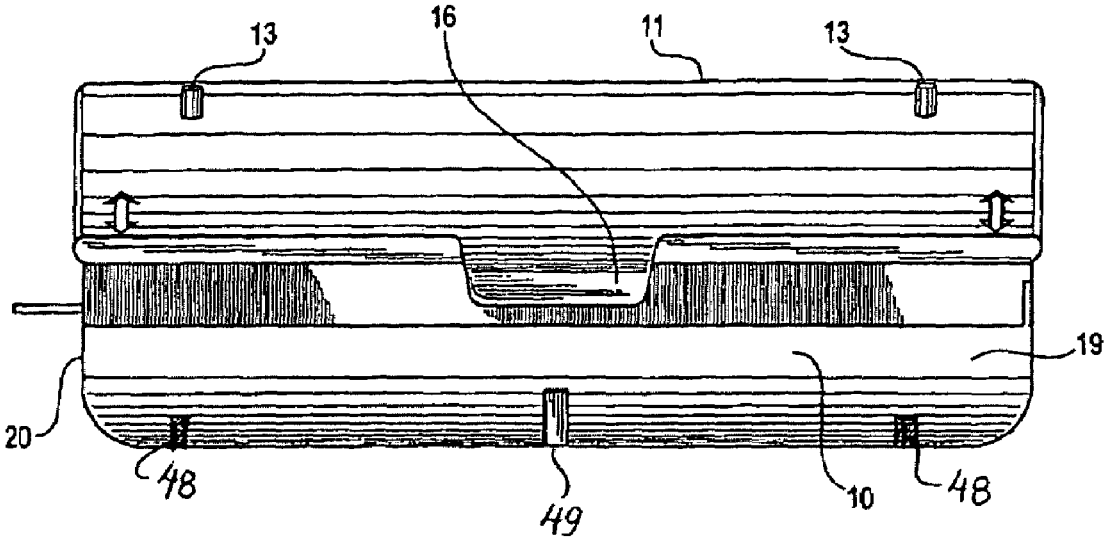
FIG. 8 is the rear view of the container showing two mortise apertures where the tenons of the container connect to assist in stacking the containers.

FIG. 8 is the rear view (45) of the rectangular portable and stackable plastic multipurpose container (10) showing two mortise apertures (48) where the tenons (13) of the other container (10) connect to assist in the stacking of the rectangular portable and stackable plastic multipurpose containers (10). Also shown is a supporting structure for the base (49).

Figure 9:
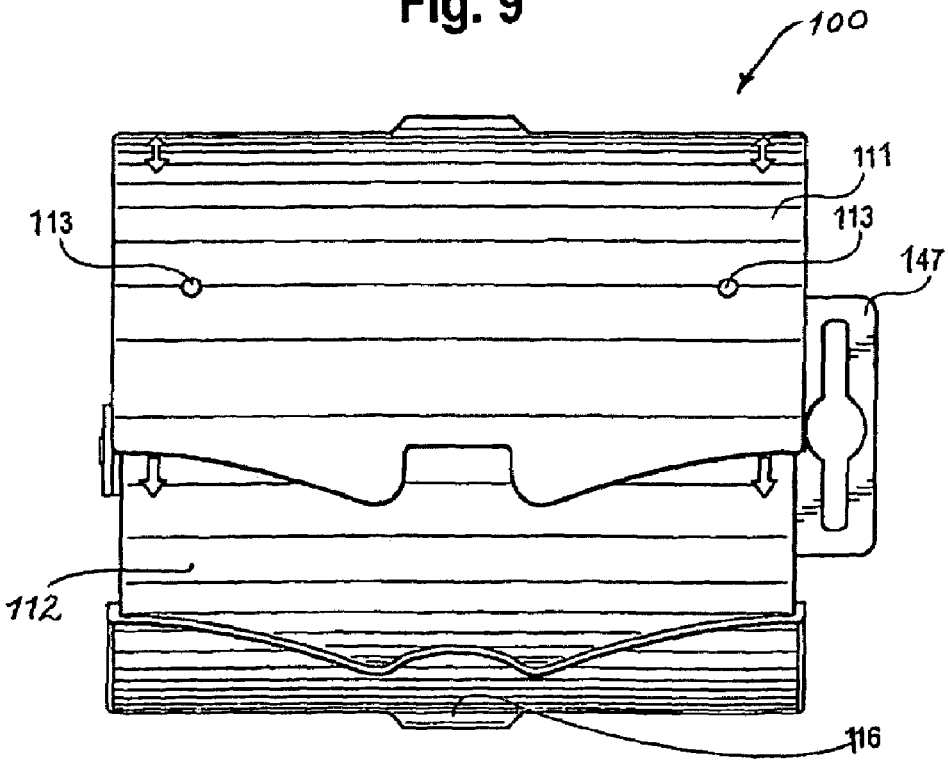
FIG. 9 is a top view of the container with both top panels closed showing two tenons.

FIG. 9 is a top view of the square portable and stackable plastic multipurpose container 100 with both panels 111 and 112 closed.

Figure 10:
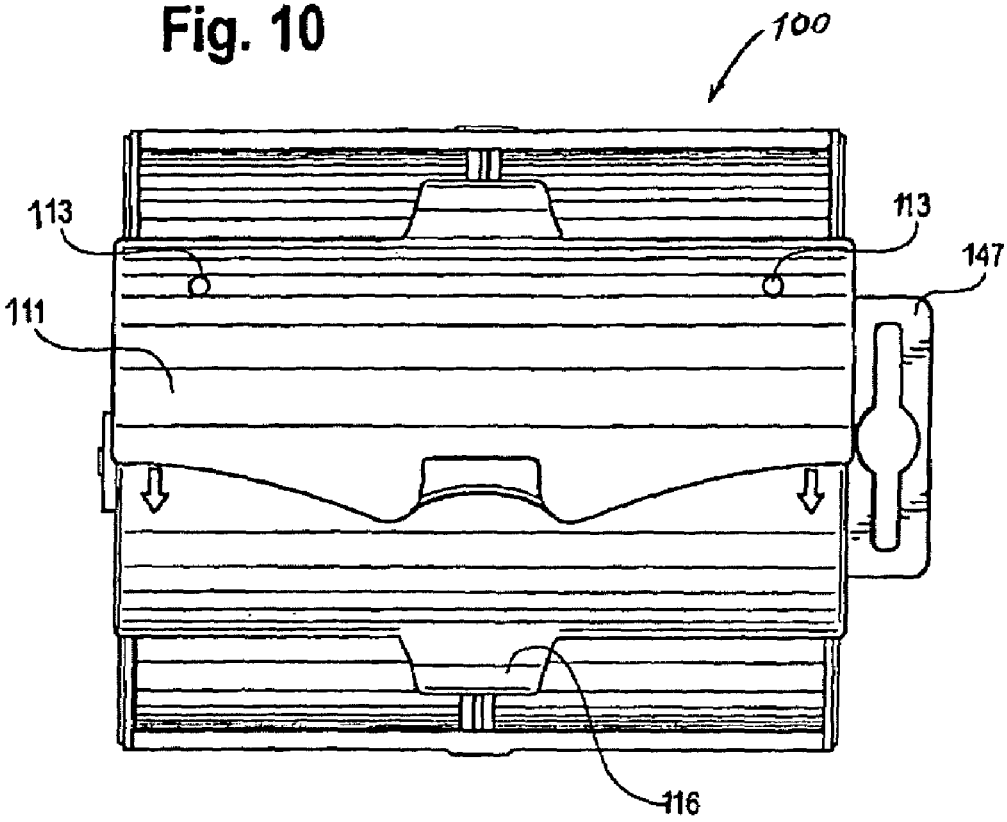
FIG. 10 is a top view of the container of FIG. 9 with both top panels open.

FIG. 10 is a view of the square portable and stackable plastic multipurpose container 100 of FIG. 9 with both panels 111 and 112 open.

Figure 11:
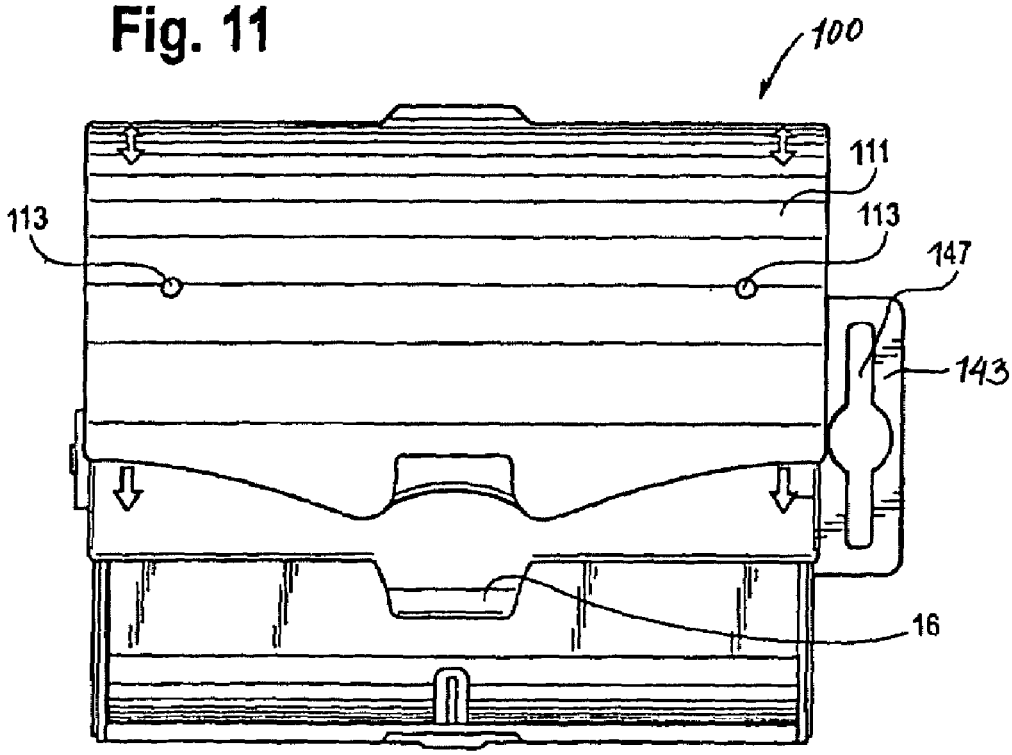
FIG. 11 is a top view of the container of FIG. 9 with one top panel open showing the connector and the aperture, which facilitates the closing of the container.

FIG. 11 is a view of the square, portable and stackable multipurpose container 100 of FIG. 9 illustrating the panels 111 and 112 and showing the tenons 113 with one side opening showing the handle 116 and the aperture 117, which facilitates the closing of the square portable and stackable plastic multipurpose container 100.

Figure 12:
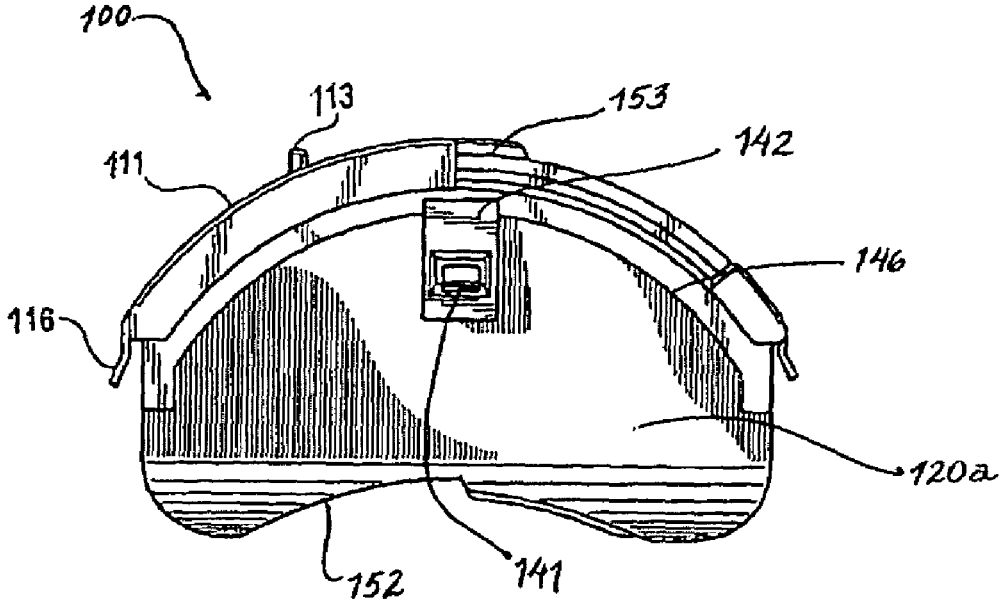
FIG. 12 is another side view of the first side of the container showing the curved upper portion of the first side wall, the base, and a connecting system whereby the top is fastened to the side wall.

FIG. 12 is side view of the square portable and stackable plastic multipurpose container 100 from a first sidewall 120*a* showing the curved upper portion 146, the curved base 152, a connecting system 153 whereby the top is fastened to the first side wall 120*a*.

Figure 13:
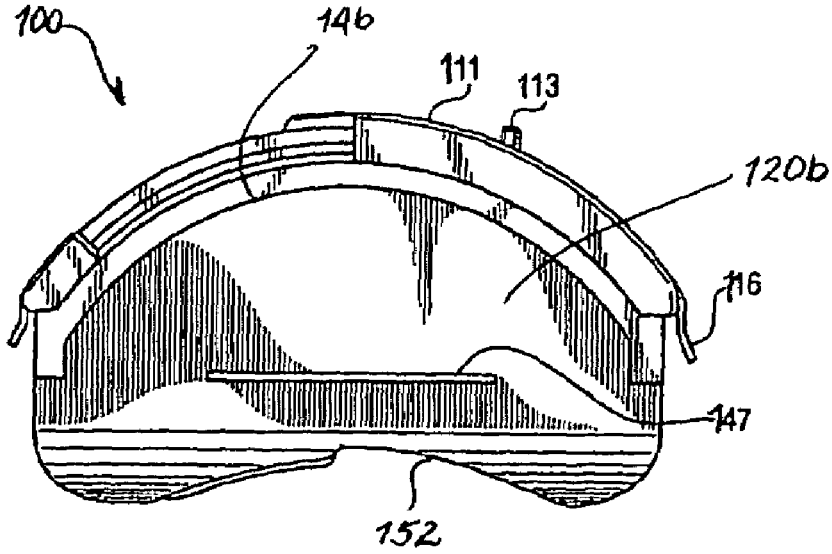
FIG. 13 is another side view of the second side of the container showing the curved upper portion of the side wall and the protruding flange, which supports the stacking of a plurality of containers.

FIG. 13 is a side view of the square portable and stackable plastic multipurpose container 100 illustrating the second side wall 120*b*, opposing the first side wall 120*a* and showing the upper portion 146 and the protruding flange 143. Suitably, wires or other fastening devices are passed through the apertures 147 (shown in FIG. 11) to form a stack of the square, portable and stackable multipurpose containers 100.

Figure 14:
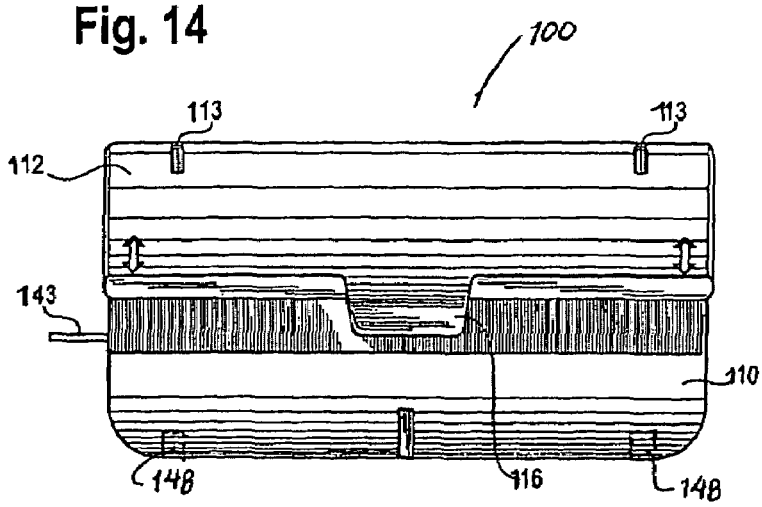
FIG. 14 is a rear view of the container showing two mortise apertures where the tenons of the container connect to assist in stacking the containers. Also showing is a supporting structure for the base.

FIG. 14 illustrates two mortise apertures 148 where the tenons 113 of the portable and stackable plastic multipurpose container 100 connect to assist in stacking the multipurpose containers 100.

Figure 15:
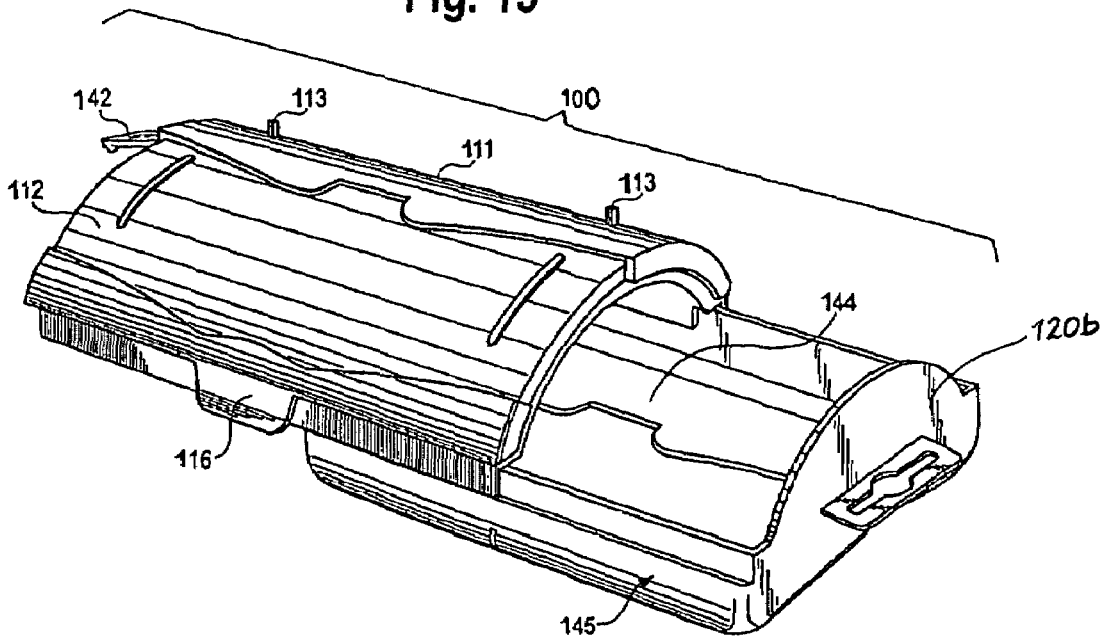
FIG. 15 is a perspective view of the container showing the top panels open and slidable laterally along the length of the front and rear walls and showing the bottom and the inside walls of the container.

FIG. 15 illustrates the top panels 111 and 112 of the rectangular portable and stackable plastic multipurpose container 100 showing the top panels open and retracted and two tenons 113. Also shown are the front wall 119, the locking mechanism 116 and the second side wall 120*b*, and a latch 142.

Figure 16:
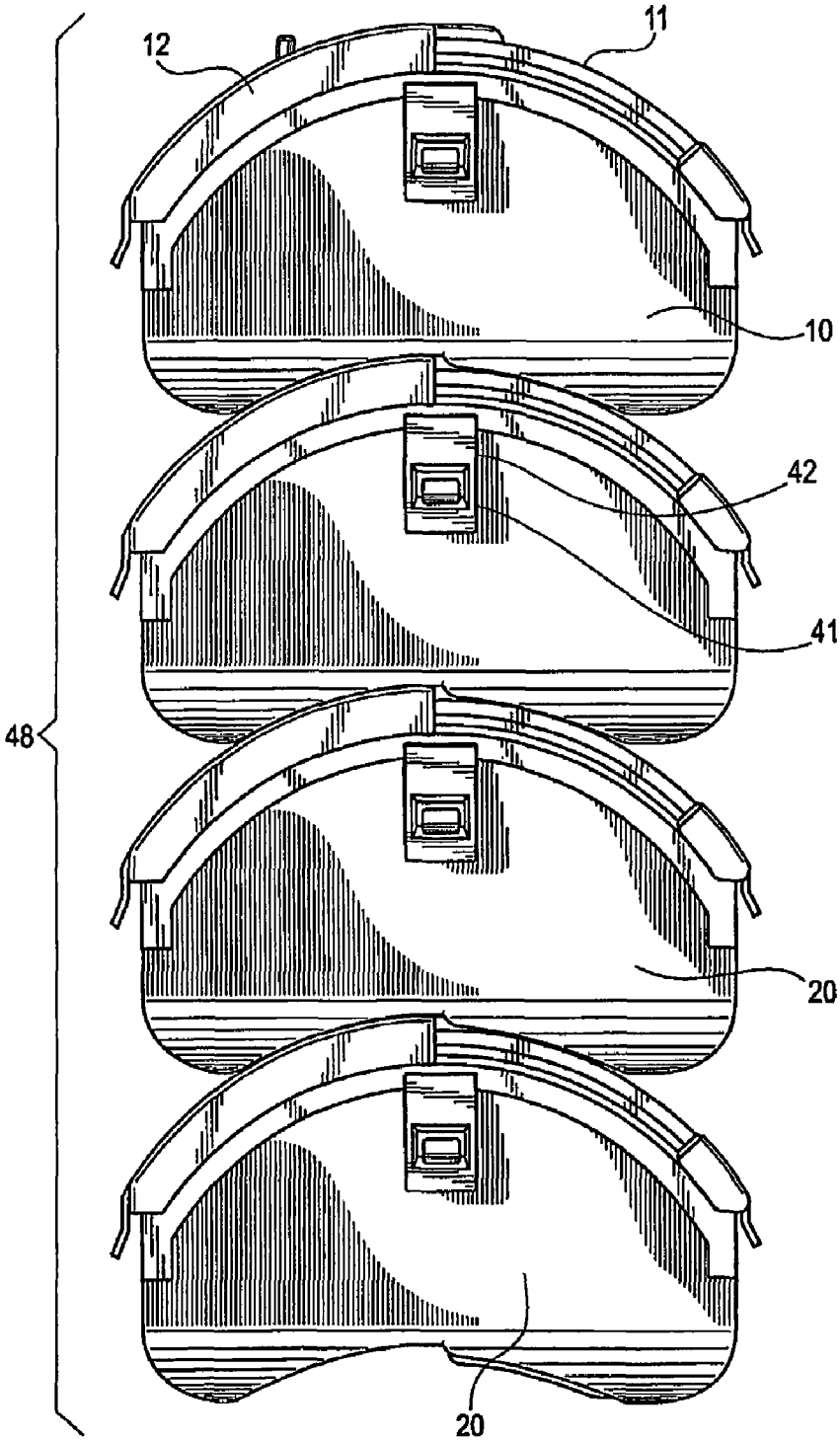
FIG. 16 is a side view of a stack of four containers shown from the first side.

FIG. 16 is a side view from the first side wall (20) of the rectangular portable and stackable plastic multipurpose container (10) showing the top panels 11, 12 closed. Also shown is a connector (41) and a latch (42) and four containers (10).

Figure 17:
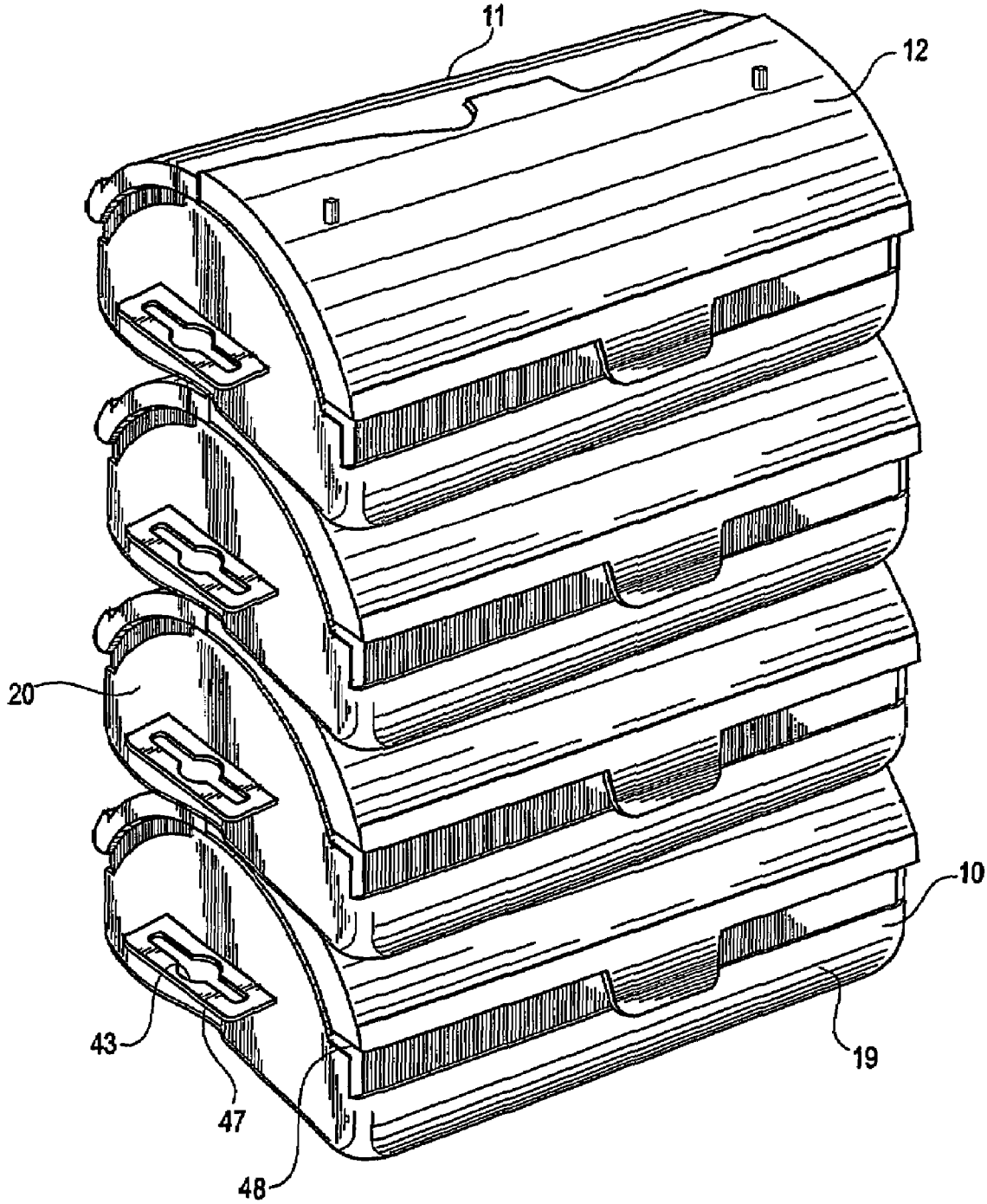
FIG. 17 is a perspective view of a stack of four containers.

FIG. 17 is a side view of a stack of four rectangular portable and stackable plastic multipurpose containers (10) shown from the second sidewall 20*b* and front wall (19). Also shown is the flange 43 and the aperture 47 in the flange 43.

Figure 18:
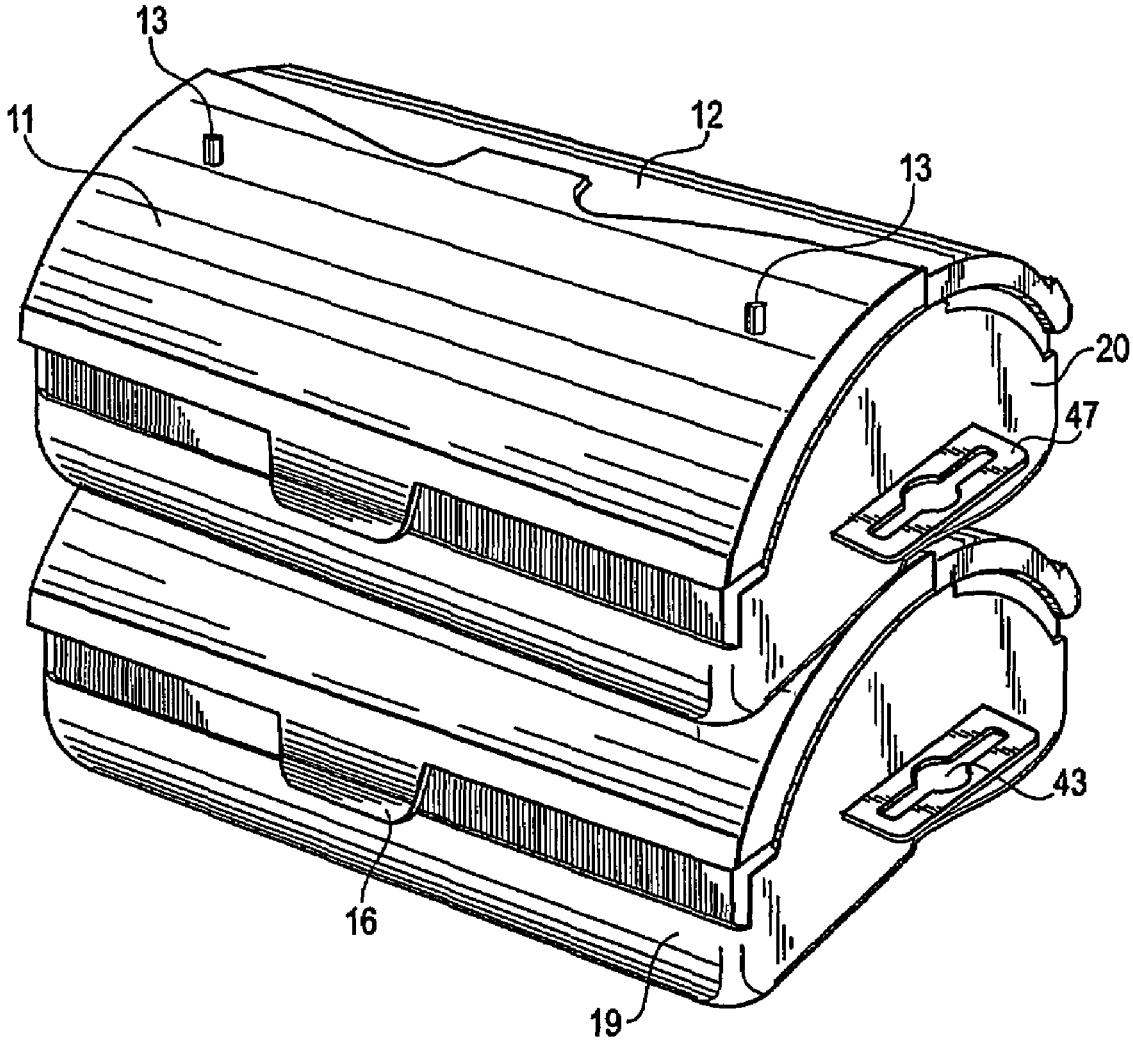
FIG. 18 is a perspective view of a stack of two containers showing the flanges on the first side of the container.

FIG. 18 is a side view of a stack of two rectangular portable and stackable plastic multipurpose containers (10) showing both the front wall (19) and the second side wall 20*b*. Also shown are the aperture (47) in the flange (43) the locking system (16), two tenons (13) and the top panels 11, 12 closed.

Various modifications to the invention are contemplated. It is understood, therefore, that within the scope of the appended claims, the invention may be practiced otherwise than specifically described.

What is claimed is:

1. A portable and stackable plastic multipurpose container comprising:

a curved base;

a curved top including two slidable panels, the panels openable from a front and rear of the multipurpose container, the top panels slidably connected to a front wall and a rear wall; and a pair of opposing substantially identical side walls extending perpendicularly from the base, the side walls having a lower portion and an upper portion, the upper portion having a top and a bottom, wherein the top of the container including the two slidable panels meets the bottom of the upper portion of the side wall, wherein the front and the rear walls extend perpendicularly from the base up to where the top having two slidable panels meet the bottom of the upper portion of the side walls, wherein the top having the pair of sildable panels is slidably positioned to open from the front wall, the rear wall, and at least one of the opposed side walls.

2. The portable and stackable plastic multipurpose container of claim 1, wherein the two panels are slidably positioned to open from at least one of a front and a rear of the container.

3. The portable and stackable plastic multipurpose container of claim 2, wherein each of the two panels has a plastic connecting member to close each of the two panels of the container.

4. The portable and stackable plastic multipurpose container of claim 1, wherein a plurality of supporting structures strengthen the base of the container.

5. The portable and stackable plastic multipurpose container of claim 4, wherein the supporting structures are located on the base inside the container and on the base outside the container.

6. The portable and stackable plastic multipurpose container of claim 1 wherein the top two panels have a plurality of tenons to facilitate stacking the portable and stackable plastic multipurpose container.

7. The portable and stackable plastic multipurpose container of claim 1 wherein a bottom of the base of a first container has a plurality of mortise apertures to receive a plurality of tenons from a second container to facilitate the stacking of the containers.

8. A portable and stackable plastic multipurpose container comprising:

a rectangular base;

a top having at least two slidable panels;

a pair of opposing substantially identical sidewalls extending perpendicularly from the rectangular base, the sidewalls with a lower portion and with a curved upper portion, the curved upper portion having a top and a bottom, wherein the top having at least two slidable panels is slidably connected to the side walls; and a front wall and a rear wall, each extending from the rectangular base, wherein the top having at least two slidable panels is slidably connected to the front and the rear walls and wherein the top is slidably positioned to open from the front wall, the rear wall, and at least one of the opposed side walls.

9. The portable and stackable plastic multipurpose container of claim 8, wherein the top is slidably positioned to open from either of the front and the rear walls.

10. The portable and stackable plastic multipurpose container of claim 9, wherein each of the at least two top panels has a plastic connecting member to close each side of the container.

11. The rectangular portable and stackable plastic multipurpose container of claim 8, wherein a plurality of supporting structures strengthen the base of the container.

12. The portable and stackable plastic multipurpose container of claim 11, wherein the supporting structures are located on the base inside the container and on the base outside the container.

13. The rectangular portable and stackable plastic multipurpose container of claim 8 wherein the top having the at least two slidable panels has a plurality of tenons to facilitate the stacking of the rectangular portable and stackable plastic multipurpose container.

14. The rectangular portable and stackable plastic multipurpose container of claim 8 wherein a bottom of the base has a plurality of mortise apertures to receive a plurality of tenons to facilitate the stacking of the containers.

15. The rectangular portable and stackable plastic multipurpose container of claim 8 wherein the container is made of polyolefin.

16. The rectangular portable and stackable plastic multipurpose container of claim 15 wherein the container is made of polypropylene.

17. The rectangular portable and stackable plastic multipurpose container of claim 15, wherein the container is made of polyethylene.

18. The rectangular portable and stackable plastic multipurpose container of claim 8 wherein a perpendicular extension is attached to one of the pair of opposing side walls, said extension having an aperture through which wires or poles can be inserted to assist in the stacking of the rectangular portable and stackable plastic multipurpose container.

19. A portable and stackable plastic multipurpose container comprising:

a square base;

a top, the top having a pair of slidable panels;

a pair of opposed substantially identical side walls extending perpendicularly from the base, the sidewalls having a lower portion and a curved upper portion, the upper portion having a top and a bottom wherein the top having the pair of slidable panels is connected to the side walls; and a front and a rear wall, each wall extending from the base to a point where the top having the pair of slidable panels meets the bottom of the curved upper portion of the side walls wherein the top having the pair of slidable panels is slidably positioned to open from the front wall, the rear wall, and at least one of the opposed side walls.

20. The square portable and stackable plastic multipurpose container of claim 19, wherein the top having the pair of slidable panels is slidably positioned to open from the pair of opposed sidewalls, from the front wall, and from the rear wall.

21. The square portable and stackable plastic multipurpose container of claim 19, wherein a plurality of supporting structures strengthen the base of the container.

22. The square portable and stackable plastic multipurpose container of claim 21, wherein the supporting structures are located on the base inside the container and on the base outside the container.

23. The square portable and stackable plastic multipurpose container of claim 19, wherein each panel of the top having the pair of slidable panels has a plastic connecting member to close each panel to one of the front and the rear walls.

24. The square portable and stackable plastic multipurpose container of claim 19, wherein the top has a plurality of tenons which facilitates stacking.

25. The square portable and stackable plastic multipurpose container of claim 19, wherein a bottom of the base has a plurality of mortise apertures to receive a plurality of tenons to facilitate stacking of the containers.

26. The square portable and stackable plastic multipurpose container of claim 19, wherein the container is made of polyolefin.

27. The square portable and stackable plastic multipurpose container of claim 26, wherein the container is made of polypropylene.

28. The square portable and stackable plastic multipurpose container of claim 26, wherein the container is made of polyethylene.

29. A stack of portable and stackable multipurpose containers comprising:

a rectangular base;

a top having at least two slidable panels;

a pair of opposing substantially identical side walls extending perpendicularly from the rectangular base with a lower portion and with a curved upper portion, the upper portion having a top and a bottom wherein the top having at least two slidable panels is slidably connected to the side walls; and a front and rear wall, each extending from the rectangular base wherein the top having at least two slidable panels is slidably positioned to open from the front wall, the rear wall, and the two opposed sidewalls, wherein for each set of a plurality of containers, a plurality of tenons of a first container are inserted in a plurality of mortise apertures of a bottom of the base of a second container.

30. A stack of portable and stackable multipurpose containers comprising:

a square base;

a top, the top having a pair of slidable panels;

a pair of opposed substantially identical side walls extending perpendicularly from the base, the sidewalls having a lower portion and a curved upper portion, the upper portion having a top and a bottom wherein the top is slidably connected to the side walls; and a front and a rear wall, each wall extending from the base to a point where the top having the pair of slidable panels of the container meets the bottom of the curved upper portion of the side walls, the top having the pair of slidable panels slidably positioned to open from the front wall, the rear wall, and at least one of the opposed side walls, wherein for each set of a plurality of containers, a plurality of tenons of a first container has been inserted in the plurality of mortise apertures of the bottom of the base of a second container.

31. The square portable and stackable plastic multipurpose container of claim 30, wherein a flange is attached to a side wall, the flange having an aperture through which wires or poles can be inserted to assist in the stacking of the square portable and stackable plastic multipurpose container.

* * * * *

UNITED STATES PATENT AND TRADEMARK OFFICE

CERTIFICATE OF CORRECTION

PATENT NO. : 7,607,550 B2
APPLICATION NO. : 10/555159
DATED : October 27, 2009
INVENTOR(S) : Lin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 753 days.

Signed and Sealed this

Twelfth Day of October, 2010

David J. Kappos

David J. Kappos
*Director of the United States Patent and Trademark Office*